United States Patent [19]

Cotton

[11] Patent Number: 4,676,168

[45] Date of Patent: Jun. 30, 1987

[54] MAGNETIC ASSEMBLIES FOR MINESWEEPING OR SHIP DEGAUSSING

[75] Inventor: Alfred B. Cotton, Weymouth, England

[73] Assignee: The Secretary of State for Defence in Her Britannic Majesty's Government of the United Kingdom of Great Britain and Northern Ireland, London, England

[21] Appl. No.: 709,021

[22] PCT Filed: Jun. 25, 1984

[86] PCT No.: PCT/GB84/00226

§ 371 Date: Feb. 25, 1985

§ 102(e) Date: Feb. 25, 1985

[87] PCT Pub. No.: WO85/00335

PCT Pub. Date: Jan. 31, 1985

[30] Foreign Application Priority Data

Jul. 4, 1983 [GB] United Kingdom ..... 8318111

[51] Int. Cl.[4] ..... F42B 22/42

[52] U.S. Cl. ..... 102/402; 367/1

[58] Field of Search ..... 102/402; 367/1, 130

[56] References Cited

U.S. PATENT DOCUMENTS

| | | | |
|---|---|---|---|
| 2,968,274 | 1/1961 | Estes et al. | 367/130 X |
| 3,119,189 | 1/1964 | Hyne | 367/130 X |
| 3,826,215 | 7/1974 | Dyjak | 102/402 X |
| 3,884,173 | 5/1975 | Fabula | 376/130 X |
| 3,893,063 | 7/1975 | Park et al. | 376/130 X |
| 3,939,753 | 2/1976 | Rosborough et al. | 102/402 X |
| 4,220,108 | 9/1980 | Burt | 102/402 X |
| 4,535,716 | 8/1985 | Hill | 102/402 X |

FOREIGN PATENT DOCUMENTS

| | | |
|---|---|---|
| 2038560 | 7/1980 | United Kingdom . |
| 1575498 | 9/1980 | United Kingdom . |

*Primary Examiner*—Peter A. Nelson

*Attorney, Agent, or Firm*—William R. Hinds

[57] ABSTRACT

The invention relates to magnetic assemblies and in particular, though not exclusively to magnets for use in mine-sweeping or ship degaussing systems.

16 Claims, 6 Drawing Figures

Fig. 1.
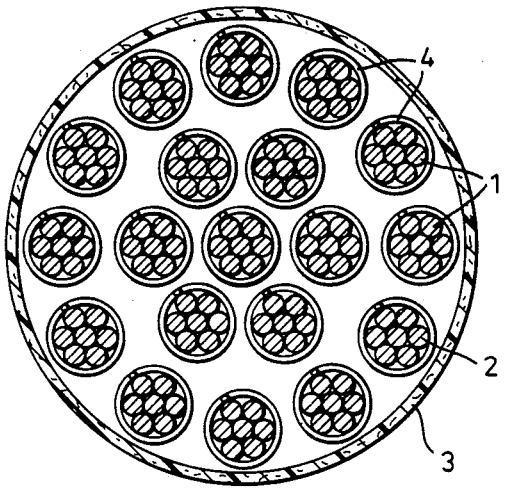
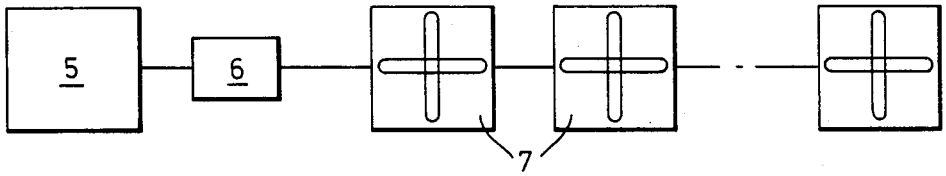
Fig. 2.
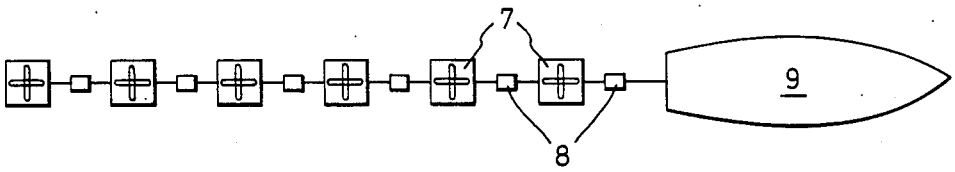
Fig. 3.

MAGNETIC ASSEMBLIES FOR MINESWEEPING OR SHIP DEGAUSSING

DETAILED DESCRIPTION OF THE INVENTION

Many ships have degaussing systems built into their structures. These systems comprise electrical coils which can be energised so that they produce a magnetic field which is equal and opposite to that of the ship so that the magnetic field of the ship is neutralised. Some ships, though, do not have built-in degaussing measures and situations may arise where such ships have to pass through mined waters. Thus a system is required which will enable such ships to be degaussed temporarily to allow them to pass through the dangerous areas.

There are a number of conventional minesweeping methods. The most common are the systems where the required magnetic fields are produced by electrically pulsed loops towed behind a ship. The loop may either be a closed loop system consisting of a large area horizontal plane loop or an open loop system consisting of two or more electrodes with the electric currents driven through the sea water between them. Other methods include a simple dc electromagnet, with a fixed magnetic moment, towed from a helicopter, and a fixed magnetic moment permanent magnet towed behind a small ship for precursor magnetic sweeping.

The object of the present invention is to provide a versatile magnetic system which can be used with a fixed or varying magnetic moment so as to be suitable for use in ship degaussing and also minesweeping systems.

The magnet system must be capable of operating in three modes:

(a) as a single moment magnet;

(b) with a gradually varying magnetic moment; and (c) with a pulsing, continuously varying magnetic moment as the situation requires.

The invention provides a magnet assembly which comprises a plurality of permanent magnets, each of which can be switched from one magnetisation saturation state (positive or negative) to the opposite magnetisation situration state, such that the overall magnetic moment of the assembly can be varied stepwise. Thus the magnet assembly will be referred to as a "variable permanent magnet". Such magnet assemblies would be particularly suitable for use in minesweeping and ship degaussing systems.

Each of the permanent magnets has a positive or negative magnetic moment depending on whether the material is positively or negatively saturated. Each magnet can then be switched from one saturation state to the other by driving the magnet into the opposite saturation state. Thus, if one permanent magnet is switched to its opposite saturation state, the overall magnetic moment of the system increases or decreases by the change in the magnetic moment of that permanent magnet.

The switching means for each permanent magnet preferably comprises a solenoid winding. Preferably a solenoid is wound around each permanent magnet and can produce a field which will force the permanent magnet into positive or negative saturation in dependence on the direction of the solenoid current. An electric pulse through the solenoid produces a magnetic field which drives the permanent magnet into saturation such that the magnet is switched from one saturation state to the opposite saturation state. Preferably there is a control circuit to connect each individual solenoid to a dc power source for sufficient time to achieve magnetic saturation.

Each permanent magnet preferably comprises a plurality of rods or cylinders. The rods or cylinders are of a permanent magnetic material and they may be arranged in a bundle.

The amount of magnetic material in the variable permanent magnet depends on the maximum total magnetic moment required. For a larger magnetic moment requirement more magnetic material must be used in the system.

As each permanent magnet bundle has its magnetic moment switched the overall magnetic moment alters stepwise. The size of the step depends on the size of the magnetic moment of the bundle, thus for a certain overall magnetic moment finer steps are achieved by using more bundles, each of less material, and coarser steps are achieved by using fewer bundles, each of more material.

Thus the amount of magnetic material in each bundle is determined by the overall magnetic moment and step size requirements and from this the number of rods or cylinders in each bundle can be determined. This is limited though by the mechanical properties of the magnetic material.

Preferably the number of bundles used and the switching sequence for the solenoids are controlled by computer programme. The solenoid pulsing sequence depends on the required magnet application: the magnet moment may be preset to a fixed value; it may vary slowly to compensate for varying conditions; or it may be continuously pulsed to give a particular waveform.

Preferably the magnetic material used is a chromium steel with between $1\frac{1}{2}$ and 12% chromium. A preferred steel contains 6% Cr and 1% C. Iron/carbon-/aluminium steels have acceptable magnetic properties, and also the advantage of being non-strategic materials, but in most cases there mechanical properties are not good enough. Some tool steels can also be used.

Advantageously the material is a permanent magnet-type with remanence and coercivity values being as high as possible. Preferably the remanence is not less than about 7000 gauss and in practice a remanence in the range 7000 to 9500 gauss may be used. The coercivity is preferably not less than 60 oersted In practice a value of about 100 oersted has been found suitable.

The variable permanent magnet is preferably able to produce a maximum total magnetic moment of a least $6\times10^4$ $Am^2$ in each magnet direction. A magnetic field of up to $10^5$ $Am^2$ is desirable but this is dependent on the material coercivity. The material and its assembly within the variable permanent magnet are preferably also strong enough to withstand explosions when used as a mine-countermeasure. The material should also be able to be formed into long rods or cylinders with very little variation from straightness over their length. Preferably it should be able to be made into rods which are out of straightness by less than about 0.1% of their length.

Preferably the variable permanent magnet comprises a number of permanent magnet bundles enclosed in a casing which does not affect the magnetic fields produced and is strong enough to withstand mine explosions. Conveniently the casing may be made of glass reinforced plastic (GRP) .

Preferably the casing is such as to make the magnet assembly buoyant so that it will float.

There is no critical arrangement of the permanent magnet bundles within the casing. Conveniently they may be arranged symmetrically about the long axis, or alternatively they may be arranged asymmetrically so as to render the system "bottom heavy" so that it will float only one way up.

The variable permanent magnet assembly may be used singly or in groups of up to 60 or more individual magnets.

Preferably each complete system uses only one external source of power and only one solenoid sequence programme for any number of individual magnets. Preferably each magnet has external connections so that power and commands can be received and passed onward to other similar magnets.

Preferably each individual variable permanent magnet can be constructed in the form of a 3-axis magnet to produce orthogonal magnetic fields.

The variable permanent magnet system may be used to simulate a ship's magnetic signature, or the signature of another object, to degauss ships or other objects, or for a minesweeping system either towed behind a ship or as part of a remote controlled precursor magnetic sweeping system.

In order that the invention may be more fully understood one embodiment thereof will now be described, by way of example only, with reference to the drawings of which:

FIG. 1 illustrates one possible arrangement for a variable permanent magnet;

FIG. 2 is a block diagram of a variable permanent magnet system;

FIG. 3 is a diagram of a variable permanent magnet system for use as a ship signature simulator;

Figure 4A:
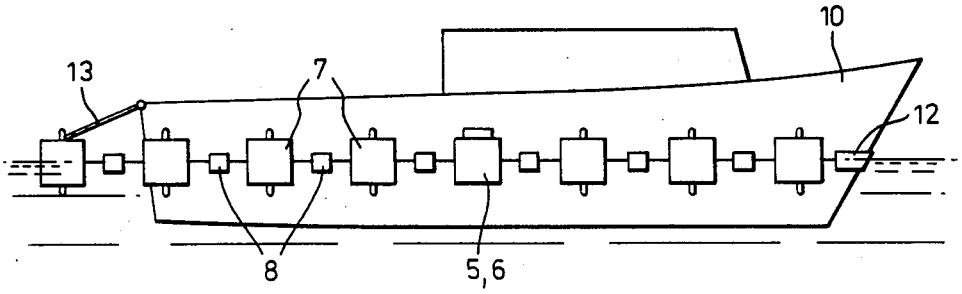
Figure 5:
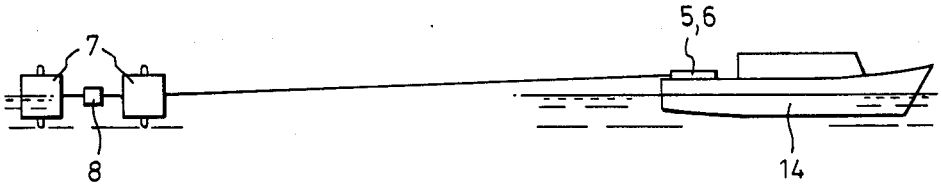

FIGS. 4A & B show a variable permanent magnet system for degaussing a ship, in side elevation and plan view; and FIG. 5 shows a variable permanent magnet system for minesweeping.

FIG. 1 shows a magnet assembly of a variable permanent magnet which comprises 19 bundles or switchable permanent magnets 1 each of 7 rods 2. Each rod 2 must not vary from the straight by more than about 0.1% of its length. The rods 2 are made of 6% chromium, 1% carbon steel which has been normally heat treated and quenched with the rods 2 being restrained during quenching to prevent bending.

The magnetic material has a remanence of at least 7000 gauss and a coercivity of about 100 oersted. The total magnetic field produced by the assembly is about $6\times10^4$ $Am^2$.

A magnet casing 3, made of GRP, encloses the bundles 1. Solenoid windings 4 are close-wound over the length of each bundle and can produce a field of 25 Ampere turns/mm which ensures that the steel is driven into saturation.

A pulse current of 27 A maximum, at 600 V, is used to fully saturate the magnetic material. A pulse length of 76 ms is used to allow time for full saturation. The pulse length limits the speed of variation of the moment by limiting the switching cycle time.

There is a further time delay introduced, making the cycle time about 150 ms, such that errors in the cycle are not able to cause two solenoids to be switched on at the same time.

If the bundle 1 is positively saturated the associated solenoid 4 can be pulsed to switch it to negative saturation and vice versa. Each magnet has two saturation states, at the positive and negative remanence points.

FIG. 2 shows a generalised arrangement of a variable permanent magnet system for use in minesweeping or ship degaussing systems which comprises a generator 5, a control box 6 and a series of variable permanent 3-axis magnets 7. As many as 60 3-axis magnets may be used and the control box must be capable of controlling the switching sequence of each one. Each 3-axis magnet has electronic circuitry to enable instructions to be accepted. The distance from the control box 6 to the 3-axis magnets 7 is limited only by the power drop in the cable link. In a system of 60 3-axis magnets there may be 300 m or more from the first to the last magnet and the distance from the control box to the first magnet can be 100 m or more and so the system must be designed to cope with this.

The magnet system is very versatile and can be used in three modes: (a) the magnetic moment of each variable permanent magnet is preset to a fixed value; (b) the magnetic moment is varied slowly; and (c) the magnetic moment is varied continuously. Examples of uses for the magnet system of FIG. 2 in the three modes are illustrated in FIGS. 3, 4 and 5.

Referring to FIG. 3, a system for use as a ship signature simulator is shown. Ship signature simulation is a method of minesweeping wherein the magnet system is used to produce a ship-type magnetic signature. A number of variable permanent 3-axis magnets 7 are arranged in a line, separated by spacers 8 with their magnetic moments preset at different fixed values so as to create the same field pattern as a ship. The magnet system is towed by a vessel 9 and when it passes near a mine the mine detects an apparent ship's magnetic signature and so explodes. In a typical arrangement 6–10 magnets are used.

Another variation of the preset signature system is target stimulation for testing of magnetic anomaly detectors.

Figure 4B:
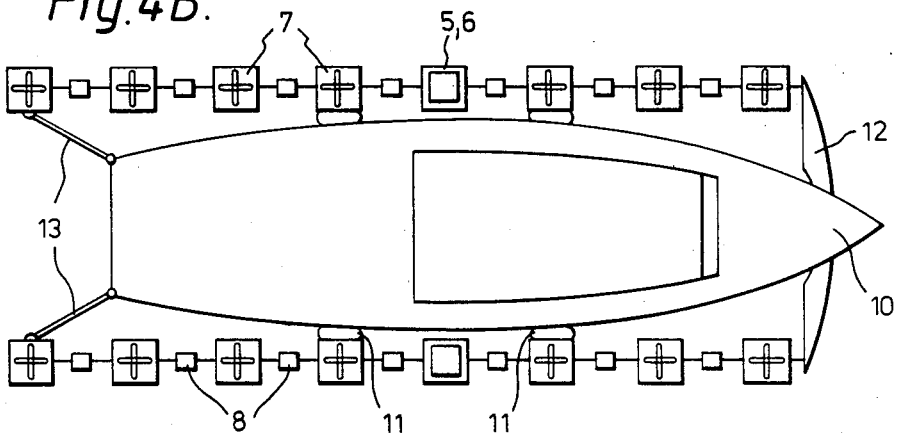

Referring to FIGS. 4A and 4B, a ship degaussing system is shown using a variable permanent magnet degaussing system for use with ships which do not have their own degaussing systems. A number of variable permanent magnets 7 is placed around a ship: the number used depending on the size of the ship and the total magnetic moment required. Each magnet 7 is a 3-axis magnet with the axes being vertical, across the ship and along the length of the ship. The magnets are contained in buoyant casings or placed on inflatable rafts so that they float around the ship. They are kept apart from each other by spacers 8 and kept at a distance of 1–2 m from the ship's sides by fender/spacers 11, bow yoke 12 and spacer struts 13 to prevent the magnets touching the ship. The generator 5 and control box 6 are arranged in the magnet line on a buoyant raft (not shown). The magnets create a magnetic field, approximately equal and opposite to that produced by the ship, to neutralise the effect of the ship's magnetic field. As the ship changes heading its field changes and so the field produced by the magnets is also changed to keep the resultant magnetic field to a minimum.

Referring to FIG. 5, a variable permanent system for use as a minesweeper is shown. One or more 3-axis variable permanent magnets 7 are towed behind a minesweeping ship 14. The magnet solenoids are pulsed to produce a continuously varying magnetic moment of a desired waveform. The generator 5 and control box 6 may be carried on the ship. The variable permanent magnets have the advantage of being buoyant and fairly small and, as only one solenoid at a time is energised, they only require small generators. Thus smaller vessels can tow the minesweep than with conventional minesweeps.

Alternatively, if one or more of the 3-axis variable permanent magnets, conveniently two of them, are connected by an overhead raft with a generator 5 and control box 6 on the raft, the buoyancy of the magnets will cause the system to float. The raft may be fitted with an outboard motor and radio control equipment and thus can form a remotely controlled precursor magnetic sweeping device.

The variable permanent magnet has many advantages over existing magnets. It is more versatile in that it can be used as a single moment magnet or a variable moment magnet. It is fairly small and requires only a small generator, thus it can be transported easily.

The magnetic moment can be reduced to zero so the magnets can be transported by air without affecting navigation devices. Thus if an area, for example an island, is surrounded by mines the magnets can be flown in by plane and any suitable ship, for example a fishing vessel, can be used to tow the magnets as a minesweep, giving a very versatile minesweeping capability. If necessary the magnets can be used to degauss a vessel for the purpose.

The magnets have possible industrial applications for adjusting or neutralising magnetic fields and as a magnetic field source for calibration purposes.

I claim:

1. A magnet assembly comprising a plurality of permanent magnets 1 characterized in that each permanent magnet 1 can be switched from one magnetization saturation state to the opposite magnetization saturation state, such that the overall magnetic moment of the assembly can be varied stepwise, by means of a solenoid 4 wound around each permanent magnet 1 such that in use it produces a field to force the permanent magnet 1 into positive or negative saturation in dependence on the direction of the solenoid current.

2. A magnet assembly according to claim 1 characterised in that there is a control circuit 6 to connect each solenoid 4 to a d.c. power source 5 for sufficient time to achieve magnetic saturation, the solenoids 4 thereby being switchable in sequence in dependence on a required time variation of the magnetic moment of the assembly.

3. A magnet assembly according to claim 1 characterised in that each permanent magnet 1 comprises a plurality of rods 2 each made of a permanent magnetic material.

4. A magnet assembly according to claim 3 characterised in that the rods 2 are arranged in bundles.

5. A magnet assembly according to claim 1 characterised in that the permanent magnets 1 are made of chromium steel containing between 1½% and 12% chromium.

6. A magnet assembly according to claim 5 characterised in that the chromium steel contains 6% chromium and 1% carbon.

7. A magnet assembly according to claim 1 characterised in that the magnetic material used has a remanence in the range of 7000 to 9500 gauss.

8. A magnet assembly according to claim 1 characterised in that the magnetic material used has a coercivity of not less than 60 oersted.

9. A magnet assembly according to claim 1 characterised in that the assembly is enclosed in a casing 3 which does not affect the magnetic fields produced and is such as to make the magnet assembly buoyant.

10. A magnet assembly according to claim 1 characterised in that the magnet assembly is constructed in the form of a 3-axis magnet to produce orthogonal magnetic fields.

11. A magnet assembly according to claim 1 characterised in that the magnet assembly has external connections so that power and commands can be received and passed onward to other such magnet assemblies.

12. A magnet assembly according to claim 1 characterised in that the magnet assembly is constructed and arranged to be towed by a vessel.

13. A method of simulating a ship's magnetic signature using magnet assemblies as described in claim 1 comprising the steps of:

(a) arranging a generator 5, a switching sequence control box 6 and a number of variable permanent magnet assemblies in series;

(b) switching the solenoids 4 to set each magnet assembly to a selected fixed magnetic moment, creating the same field pattern as a ship; and (c) towing the system behind a vessel 9.

14. A method of degaussing a ship using magnet assemblies as described in claim 1 comprising the steps of:

(a) placing a number of variable permanent magnet assemblies in series around a ship;

(b) including a generator 5 and a switching sequence control box 6 in series with the magnet assemblies;

(c) switching the solenoids 4 to create a magnetic field approximately equal and opposite to that produced by the ship; and (d) varying the magnetic field to compensate for changes in the ship's magnetic field as the ship changes its heading, keeping the resultant magnetic field to a minimum.

15. A method of minesweeping using magnet assemblies as described in claim 1 comprising the steps of:

(a) towing a number of variable permanent magnet assemblies behind a minesweeping vessel 14;

(b) including a generator 5 and a switching sequence control box 6 in series with the magnet assemblies; and (c) switching the solenoids 4 in a pulsing sequence so as to produce a continuously varying magnetic moment of a desired waveform.

16. A method of precursive minesweeping using magnet assemblies as described in claim 1 comprising the steps of:

(a) connecting a number of variable permanent magnet assemblies by a raft;

(b) placing a generator 5, a switching sequence control box 6, an outboard motor and radio control equipment on the raft; and (c) switching the solenoids 4 in a pulsing sequence so as to produce a continuously varying magnetic moment of a desired waveform;

so that the system is directed by remote control at a distance from a vessel.

* * * * *